US011261859B2

(12) United States Patent
Zahran

(10) Patent No.: US 11,261,859 B2
(45) Date of Patent: Mar. 1, 2022

(54) GAS-CHARGED UNLOADING PLUNGER

(71) Applicant: Saudi Arabian Oil Company, Dhahran (SA)

(72) Inventor: Amr Mohamed Zahran, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/890,615

(22) Filed: Jun. 2, 2020

(65) Prior Publication Data

US 2021/0372241 A1 Dec. 2, 2021

(51) Int. Cl.

| | |
|---|---|
| ***F04B 47/12*** | (2006.01) |
| ***E21B 43/12*** | (2006.01) |
| ***E21B 33/068*** | (2006.01) |
| ***E21B 34/02*** | (2006.01) |
| ***E21B 34/06*** | (2006.01) |

(52) U.S. Cl.

CPC ..... *F04B 47/12* (2013.01); *E21B 33/068* (2013.01); *E21B 34/02* (2013.01); *E21B 34/06* (2013.01); *E21B 43/121* (2013.01)

(58) Field of Classification Search

CPC ..... F04B 47/12; E21B 43/121; E21B 43/13; E21B 43/122; E21B 43/123; E21B 34/06; E21B 34/02; E21B 33/068

See application file for complete search history.

(56) References Cited

U.S. PATENT DOCUMENTS 2,038,426 A 4/1936 Fletcher
2,577,210 A * 12/1951 Ruska ..... E21B 49/082 166/64
2,762,308 A 9/1956 Tomlinson
4,211,279 A 7/1980 Isaacks
5,472,054 A * 12/1995 Hinds ..... E21B 34/10 166/106
6,148,923 A 11/2000 Casey
6,705,404 B2 3/2004 Bosley et al.
6,830,108 B2 12/2004 Rogers
6,966,366 B2 11/2005 Rogers
7,080,692 B1 7/2006 Kegin
7,188,670 B2 3/2007 Amies et al.
7,337,854 B2 3/2008 Horn et al.
8,181,706 B2 5/2012 Tanton
8,985,221 B2 3/2015 Mazzanti
9,206,676 B2 12/2015 Quigley et al.
9,322,251 B2 4/2016 Mazzanti
(Continued)

FOREIGN PATENT DOCUMENTS

CN 109209305 * 11/2018 ..... E21B 43/122

OTHER PUBLICATIONS

PCT International Search Report and Written Opinion in International Appln. No. PCT/US2021/035118, dated Sep. 14, 2021, 13 pages.

*Primary Examiner* — George S Gray
(74) *Attorney, Agent, or Firm* — Fish & Richardson P.C.

(57) ABSTRACT

An unloading plunger having a chamber for compressed gas and a method for unloading liquid from a wellbore via ascending of the unloading plunger including ascending via formation pressure the unloading plunger from the bottom portion of the wellbore to a rest position at a wellhead and releasing compressed gas from the chamber into the wellbore during the ascending to decrease hydrostatic pressure of liquid in the wellbore above the unloading plunger.

37 Claims, 3 Drawing Sheets

(56) References Cited

U.S. PATENT DOCUMENTS

| | | | | |
|---|---|---|---|---|
| 2006/0249284 | A1* | 11/2006 | Victor | E21B 43/121 166/105 |
| 2008/0135239 | A1* | 6/2008 | Edwards | E21B 49/084 166/264 |
| 2009/0038788 | A1* | 2/2009 | Farris | E21B 27/02 166/53 |
| 2011/0073322 | A1 | 3/2011 | Smith et al. | |
| 2012/0318524 | A1* | 12/2012 | Lea, Jr. | E21B 34/02 166/372 |
| 2018/0334890 | A1 | 11/2018 | Stadler et al. | |

* cited by examiner

100

300

GAS-CHARGED UNLOADING PLUNGER

TECHNICAL FIELD

This disclosure relates to employing plunger lift to unload a well.

BACKGROUND

A well may be unloaded by removing a column of kill fluid from the wellbore to initiate flow from the subterranean formation (reservoir). Practices for unloading a well may include circulation of lower density fluid, nitrogen lifting, swabbing, plunger lift, and so on. The selection of the technique employed may depend on the well completion design, reservoir characteristics, and other factors. Plunger lift is an artificial lift technique for unloading a well that utilizes well energy of formation pressure to cycle a plunger (e.g., traveling piston) up the tubing or casing of a well. The plunger may serve as a solid interface between the liquid above the plunger and the fluid (e.g., primarily gas) below the plunger. The fluid below the plunger may supply the energy (via formation pressure) to propel the plunger (and the liquid slug above the plunger) to the Earth surface. Once the plunger is at the surface, the well may produce hydrocarbon from the subterranean formation. Then, when a column of liquid again accumulates in the wellbore, the well (wellbore) may be shut in to facilitate (allow) the plunger to drop back to bottom. Another cycle may begin once the well has built up sufficient pressure. Cycle frequency may vary with each well and type of production.

Plunger lift is an artificial-lift alternative applied to gas and oil wells typically having high gas-liquid ratio (GLR). Plunger lift may be an artificial-lift technique principally utilized in gas wells to unload liquid (e.g., condensate, water, etc.). However, plunger lift is also applied to oil wells with high GLR and oil wells without high GLR. Again, plunger lift is a type of gas-lift method that employs a plunger that goes up and down inside the tubing. The plunger provides an interface between the liquid phase above the plunger and the lift gas below the plunger to reduce liquid fallback.

SUMMARY

An aspect relates to a method of operating a well having a wellhead and associated wellbore in a subterranean formation. The method includes descending, via gravity, an unloading plunger from a rest position at the wellhead to a bottom portion of the wellbore. The unloading plunger has a chamber having compressed gas. The method includes ascending, via formation pressure, the unloading plunger from the bottom portion of the wellbore to the rest position at the wellhead. The method includes releasing the compressed gas from the chamber into the wellbore during the ascending to decrease hydrostatic pressure of liquid in the wellbore above the unloading plunger. The method includes unloading the liquid from the wellbore via the ascending of the unloading plunger.

Yet another aspect relates to a method of operating a well having a wellhead operationally coupled to a wellbore in a subterranean formation. The method includes closing a production valve at the wellhead to shut-in the wellbore and descending, via gravity, an unloading plunger from the wellhead through production tubing to a bottomhole of the wellbore. The unloading plunger has an internal chamber having compressed gas. The method includes opening the production valve and ascending, via formation pressure, the unloading plunger from the bottomhole through the production tubing to the wellhead. The method includes decreasing hydrostatic pressure of liquid above the unloading plunger in the production tubing during the ascending by discharging, via a timer-operated valve of the unloading plunger, the compressed gas from the internal chamber through the timer-operated valve into the liquid. The method includes unloading the liquid from the well via the ascending of the unloading plunger, wherein the unloading includes flowing the liquid from the production tubing through the production valve.

Yet another aspect relates to a method of operating a well having a wellbore in a subterranean formation and a wellhead at Earth surface adjacent to the wellbore. The method includes introducing gas into an internal chamber of an unloading plunger. The method includes setting a timer on the unloading plunger for operating position of a valve disposed at a discharge opening of the internal chamber. The operating position includes closed and open. The method includes descending the unloading plunger from the wellhead through production tubing to below liquid in the production tubing, wherein the operating position of the valve is closed during the descending. The method includes opening a production valve at the wellhead and ascending the unloading plunger through the production tubing to displace the liquid above the unloading plunger through the production valve to unload the liquid from the production tubing. The ascending includes discharging the gas from the chamber through the valve into the liquid in the production tubing above the unloading plunger to decrease hydrostatic pressure of the liquid.

Yet another aspect relates to an unloading plunger to unload liquid from a well. The unloading plunger includes a body to interface with an inside surface of production tubing in a wellbore to provide a seal in the production tubing between above the unloading plunger and below the unloading plunger. The unloading plunger includes an internal chamber to hold a compressed gas. The internal chamber has a chamber inlet to receive the compressed gas into the internal chamber and an outlet to discharge the compressed gas from the internal chamber. The unloading plunger includes a timer-operated valve disposed at the chamber outlet to prevent flow of the compressed gas through the outlet when operating position of the timer-operated valve is closed and to provide flow of the compressed gas through the outlet from the internal chamber when the operating position is open. The unloading plunger includes a nozzle in the body to receive the compressed gas from the internal chamber through the timer-operated valve and discharge the compressed gas from the unloading plunger.

The details of one or more implementations are set forth in the accompanying drawings and the description below. Other features and advantages will be apparent from the description and drawings, and from the claims.

DETAILED DESCRIPTION

Figure 1:
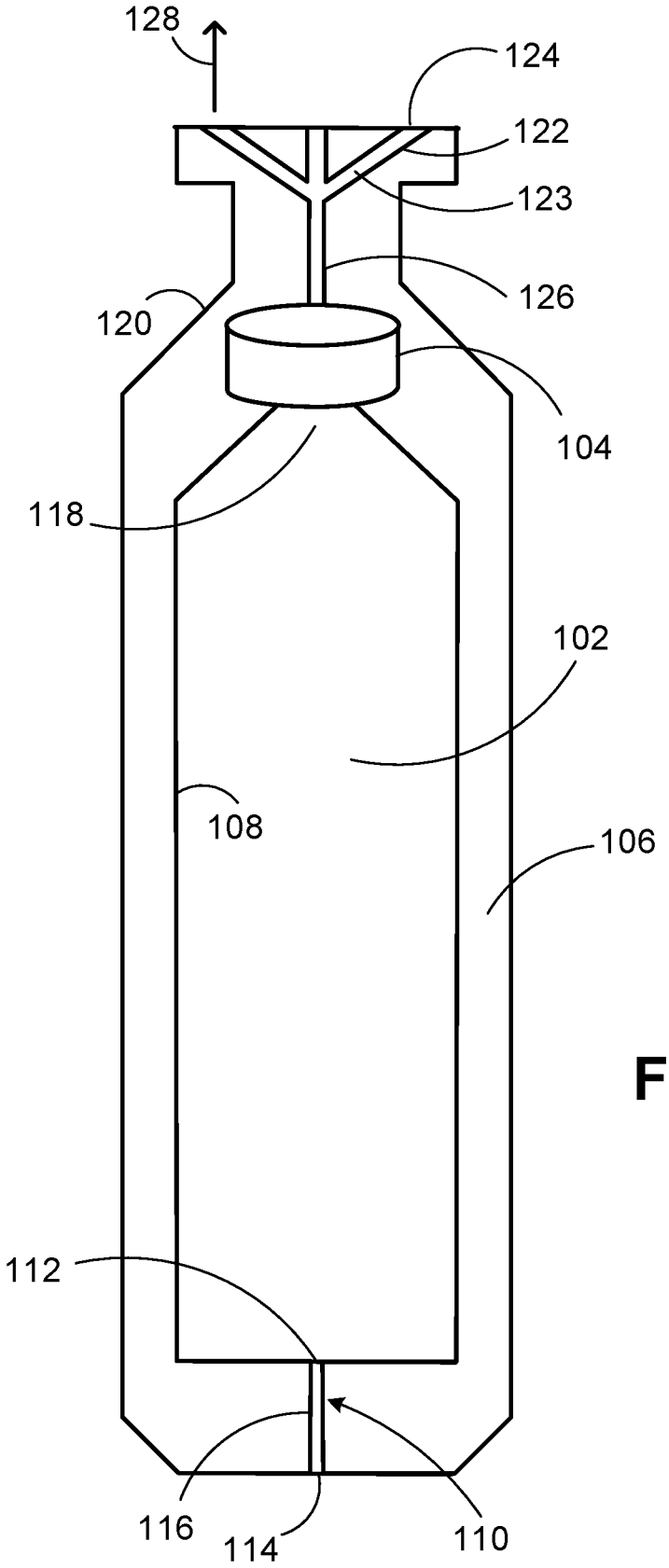
FIG. 1 is a diagram of an unloading plunger to be utilized in plunger lift applications for gas wells, oil and gas wells, and oil wells.

Plunger lift is an artificial lift mechanism for high gas-liquid ratio (GLR) oil wells and for gas well deliquification.

The plunger (e.g., a solid plunger or a flow-through plunger) may act as interface between the wellbore fluids to facilitate utilizing the wellbore pressure to produce the well. The plunger lift utilizes reservoir natural energy to lift the accumulated liquid in the wellbore to restore or increase production in liquid-loaded wells. The plunger may be implemented without an external power source in embodiments. Once the reservoir energy ceases to cycle the plunger naturally because of inadequate bottomhole pressure or formation pressure, lifting mechanisms other than plunger lift may be considered. In startup and commissioning cases, swabbing or coiled-tubing intervention may be considered to kick off the well and then for the plunger lift to operate.

Aspects of the present disclosure are generally directed to artificial lift for deliquification in oil wells, gas wells, and oil and gas wells. Some aspects are directed to plunger lift employing an unloading plunger that is gas-charged, such as nitrogen-charged. In particular, the plunger has an internal chamber that holds (stores) high-pressure gas, such as nitrogen. The plunger can have a hollow portion that is the internal chamber. The plunger has an internal timer that regulates when the compressed gas is released from the internal chamber. A top part of the plunger may be removable to provide access to adjust the timer. The timer settings may be adjusted, for example, based on well conditions.

In operation, the pressurized gas is discharged from the internal chamber after the plunger reaches the bottom of the well. The plunger may discharge the high-pressure gas through jetting nozzles into the above liquid after the plunger arrives bottom hole and during the ascending of the plunger. The discharge of the gas through the jetting nozzles may reduce hydrostatic pressure to help with unloading the well. The plunger ascends and the compressed gas is discharged through the nozzles on the plunger into the above liquid head to facilitate lifting the well in loaded conditions. The plunger includes the timer for specifying when to release the compressed gas. The discharge of the gas may be via utilization of the timer that allows (provides for) the discharging the high-pressure gas, e.g., nitrogen (N2), as the plunger travels to the surface. The plunger in operation may uniquely act in part as a travelling downhole gas-lift valve.

The gas-charged unloading plunger of present embodiments incorporates the internal high-pressure gas chamber and the timer. The internal chamber provides for storing pressurized gas that can be discharged. The pressurized gas may be discharged, for example, when or after the plunger reaches a bottom portion of the well and also during ascent of the plunger. The plunger may discharge the pressurized gas (e.g., nitrogen) through plunger nozzles into the liquid column above the plunger. The nozzles may be designed, for example, to give a desired mass rate or velocity of the discharged pressurized gas into the liquid to promote lifting the well in loaded conditions. In examples, multiple plunger-lift cycles may be implemented based on the well conditions and the unloading. Embodiments may employ plunger lift to unload the wells without swabbing or coiled-tubing intervention in certain implementations. Swabbing and coiled-tubing intervention can add significant cost and operational risk.

In some applications, the present plunger may facilitate kicking off the well without swabbing or coiled tubing intervention to unload the well. Embodiments of the present plunger-lift techniques may also advance utilizing the plunger in depleted reservoirs where the reservoir energy is inadequate to cycle a conventional plunger and where conventional plunger unloading may employ external power. Implementations may expand the operating range of plunger lift in covering depleted and low-pressure wells. Examples may promote producing the wells for longer periods utilizing the reservoir natural energy generally without an external power source for the plunger. Some embodiments can avoid expensive interventions to unload the wells.

FIG. 1 is an unloading plunger 100 that can be utilized in plunger lift applications for gas wells, oil and gas wells, or oil wells. In the illustrated embodiment, the unloading plunger 100 is an intermittent-style plunger, and not a flow-through plunger having an internal bypass valve or internal bypass flow passage.

The unloading plunger 100 has an internal chamber 102 and an internal timer-operated valve 104 to release gas from the internal chamber 102. The internal chamber 102 is an internal (interior) cavity within the body 106 of the unloading plunger 100. The inside surface 108 of the body 106 defines the internal chamber 102. The body 106 may be labeled as a wall of the internal chamber 102. A compressed gas (e.g., nitrogen, air, inert gas, etc.) may be added to the internal chamber 102. In examples, the pressure in the internal chamber 102 with the compressed gas (before release) may be at least 1000 pounds per square inch gauge (psig) or in a range of 1000 psig to 5000 psig. The pressure may be outside of this numerical range.

The unloading plunger 100 includes a body inlet 110 to provide gas through an inlet opening 112 of the internal chamber 102 to add gas to the internal chamber 102. The body inlet 106 includes an opening 114 at the exterior surface of the body 106 and a passage 116 through the body 106 to the chamber inlet opening 112. The body inlet 106 may be characterized, for example, as an injection port or inlet nozzle in some embodiments. The body inlet 106 may have, for example, a stem valve or check valve to add gas to reach the desired internal pressure in the internal chamber 102. In certain implementations, an external valve can be employed in combination with the body inlet 106 to facilitate injection of the gas into the internal chamber 102. After introduction of the gas, the body inlet 106 may be closed in particular implementations, for example, by inserting a plug into the body inlet 106, and the like.

In operation, the internal chamber 102 may be charged with gas (e.g., nitrogen) each cycle (or most cycles) of the plunger lift. The charging may be manual or automated. In examples, the unloading plunger 100 may be accessible for injecting gas into the internal chamber 102 at a rest position (e.g., lubricator) at the wellhead in or between cycles. The gas may be added to the unloading plunger 100 in place at the wellhead. On the other hand, the unloading plunger 100 may be removed from the wellhead and the gas introduced, and the unloading plunger 100 placed back in the rest position at the wellhead.

As mentioned, the internal chamber may be charged with the compressed gas to a specified pressure. The pressure specified may be based on or correlative with the volume (or mass) and velocity of the ejected gas (e.g., nitrogen) to unload a specific well. The pressure specified may be in response to the amount (e.g., volume and height) of liquid to unload. The orifice size of the ejection nozzles (e.g., 122) is generally considered in determining ejection velocity and volume. The chamber 102 pressure may be specified (in combination with the nozzle orifice size) to give an adequate amount of ejected gas during the cycle.

In implementations, the chamber 102 may expend (eject) most or substantially all of the compressed gas in a cycle. In other words, for those implementations, the internal chamber 102 may generally fully deplete in a single cycle. However, in other implementations, the availability in the chamber 102 of the charged compressed gas may last more than one cycle, such as for shallow wells. The plunger lift in deeper wells may typically rely on charging the plunger every cycle or most cycles.

The internal chamber 102 includes a discharge opening 118 (chamber outlet) to release the compressed gas from the internal chamber 102. In implementations, the timer-operated valve 104 in a closed operating position prevents flow of the compressed gas through the discharge opening 118. Conversely, the timer-operated valve 104 in an open operating position may provide flow of the compressed gas from the internal chamber 102 through the discharge opening 118 and through or adjacent the timer-operated valve 102. The timer-operated valve 102 includes a timer and a valve.

The timer may include at least two time settings and may cycle through the time settings in operation. In examples, a first setting is a length of time that the valve is to be in a closed operating position in a cycle. A second setting is a length of time in a cycle that the valve is to be in an open operating position in a cycle. The user or human operator (or electronic controller) may consider well conditions and other information in determining, specifying, and inputting (entering) the time values to the timer for the time settings. Well conditions considered may include, for example, plunger fall velocity and depth, well shut-in time to build the bottomhole pressure, and so forth.

For a user or human operator to access the timer of timer-operated valve 104 to input and adjust the timer settings, the unloading plunger 100 may have a removable upper portion 120 of the body 106. The removable upper portion (top portion) may be labeled as a removable head or removable head portion. In certain implementations, the removable upper portion 120 is threaded to the remaining (lower) portion of the body 106. Thus, the connection between the upper portion 120 (removable head) and the remaining portion of the body may be a screwed connection. The interface may include mating threads. The upper portion 120 of the body 106 may have threads that mate with threads on the remaining portion of the body 106.

The timer settings of the timer-operated valve 104 may generally be input and set prior to entry of the unloading plunger 100 into operation of the well system. In implementations, the unloading plunger 100 may be available at a rest position at the wellhead to adjust the timer settings during operation of the well system. The removable upper portion 120 (removable head) may be unscrewed from the unloading plunger 100 in place at the wellhead for access to the timer. The removable upper portion 120 may be screwed back onto the unloading plunger 100 at the rest position. On the other hand, the unloading plunger 100 may be retrieved from rest position at the wellhead, and the removable upper portion 120 unscrewed and the timer settings adjusted. The removable upper portion 120 may be screwed back onto the unloading plunger 100 and the unloading plunger 100 placed back in the rest position at the wellhead.

The valve of the timer-operated valve 104 may be an on/off valve that operates in an open position or closed position. In examples, the valve may be a ball valve, or a plug or plate, etc. The valve be a plug that inserts into the discharge opening 118 in a closed operating position and is raised from the discharge opening 118 in an open operating position. The valve may be a plate resting or pressed on the discharge opening 118 in a closed operating position and pushed (displaced) to the side (or raised) revealing the discharge opening 118 in an open operating position. Other examples may be implemented. Other valve types and configurations are applicable.

The timer may be an electronic or digital timer. The unloading plunger 100 may have a battery to provide power (electricity) to the electronic or digital timer. In other implementations, the timer may be a mechanical timer (analog timer, manual timer, etc.) that does not require power (electricity). As is typical, the mechanical timer may utilize clockwork and have a mainspring to run the timer. In implementations, the energy in the mainspring may cause a balance wheel to rotate back and forth. Each swing of the wheel may release the gear train to move an indicator or counter by a small fixed amount. Other configurations of a mechanical timer are applicable, as can be appreciated.

The timer can have a valve actuator to drive the valve such as to drive the valve position or valve operating position. As mentioned, the valve may be an on/off valve. In other words, the valve operation position may include, for example, two operating positions of closed and open. The closed operating position may be fully closed (100% closed). The open operating position may be partially open or fully open (100% open). In operation, the timer may set the operating position of the valve via the actuator per the timer setting and time expired. For a mechanical (analog) timer, the valve actuator may include a spring and/or be spring-wound (or spring-loaded). The actuator may include a rod, bar, pivoted bar, teeth, diaphragm, clamp, latch, catch, wheel, ratchet, ratchet wheel, pivoted tongue, sliding bolt, piston, notches, pawl, shaft, cam, etc. While the timer-operated valve 104 is a unique application, timer-operated valves in general including those with mechanical timers (that do not rely on electrical power or electricity) and their operation are understood by one of ordinary skill in the art.

In one example, the timer is similar to timers utilized for downhole samplers (downhole sampler tool) that are lowered into a wellbore. A downhole sampler tool may be triggered by a timer with a mechanical clock in the tool or by an electric signal conveyed by electric line. More common for downhole samplers is the timer with a mechanical clock in the downhole sampler, and the downhole sampler tool run with a wireline unit.

In an example for the timer-operated valve 104 on the unloading plunger 100 as an analog timer having a mechanical clock, the valve is a plate and the timer valve actuator is spring-loaded to move the plate away from the discharge opening 118 for the open position, and allow the plate to return to the discharge opening 118 in the closed position. In the closed position, the plate may rest on the discharge opening 118 sealing the opening 118 and preventing flow of compressed gas from the internal chamber 102 through the discharge opening 118. To move the plate for the open position, the actuator may raise the plate or push (displace) the plate to the side, revealing the discharge opening 118 for flow of the compressed gas.

In the illustrated embodiment, the unloading plunger 100 includes discharge nozzles 122 through a top portion of the body 106. This example includes three nozzles 122. Each nozzle has a passage portion 123 and an ejection opening 124 at the exterior surface of the body 106 to discharge the compressed gas. In the depicted example, a passage 126 (a common passage) in the body 106 may couple the discharge opening 118 (and valve 104) with the nozzles 122. The passage 126 may be a conduit installed in the body 106 or a cavity formed in the body 106, and the like. In operation, the compressed gas may flow from the internal chamber 102 through discharge opening 118 and through or adjacent the opened timer-operated valve 104, and through the passage 126 and nozzles 122 to outside of the unloading plunger 100. The compressed gas may eject from the ejection openings 124 of the nozzles 122 in directions to above the unloaded plunger 100, as generally indicated by arrow 128. The nozzles 122 may be sized and the pressure in the internal chamber 102 specified to give a desired volume and velocity of the compressed gas discharged, such as into the liquid column above the plunger 100 in operation. The nozzle flow-passage length and diameter, nozzle orifice diameter, etc., and the chamber 102 pressure may be specified to give a desired velocity or amount (rate) of the compressed gas ejected. The sizing of the nozzle orifice may depend or based on or correlative with (or in response to) the well depth and height (and weight) of the expected liquid column to be lightened with the discharge compressed gas.

In operation, the discharge of the compressed gas through the nozzles 122 from the top portion of the plunger 100 may facilitate the plunger 100 to ascend. The plunger 100 is lifted by underlying well pressure. The gas discharge through the nozzles 122 may lighten the fluid column above the plunger 100 to promote unloading the well with less or reduced bottomhole well pressure. The ejection of the compressed gas (e.g., nitrogen) from the nozzles 122 advances the lift (unloading the well) by introducing gas bubbles to reduce hydrostatic pressure. Thus, the plunger 100 may innovatively act as a travelling downhole gas-lift valve in certain examples. The unloading plunger 100 as employed in plunger lift may provide to produce wells for longer periods utilizing the reservoir natural energy because in operation the hydrostatic pressure above the plunger is less with the ejected compressed gas and thus less reservoir pressure (bottomhole pressure) is needed to ascend the plunger and unload the well. The unloading plunger 100 may extend the operating envelop of plunger lift to cover depleted wells with lower energy. Moreover, for startup and commissioning cases, the unloading plunger 100 may permit to avoid swabbing or coiled tubing intervention for kick off the well and allow plunger lift to operate. Typical wells loaded prior to plunger installation may require expensive slickline swabbing or coiled tubing intervention to kick off the well. However, the unloading plunger 100 and associated present techniques may facilitate unloading such a well via multiple cycles without the swabbing or coil tubing intervention in certain instances.

Figure 2:
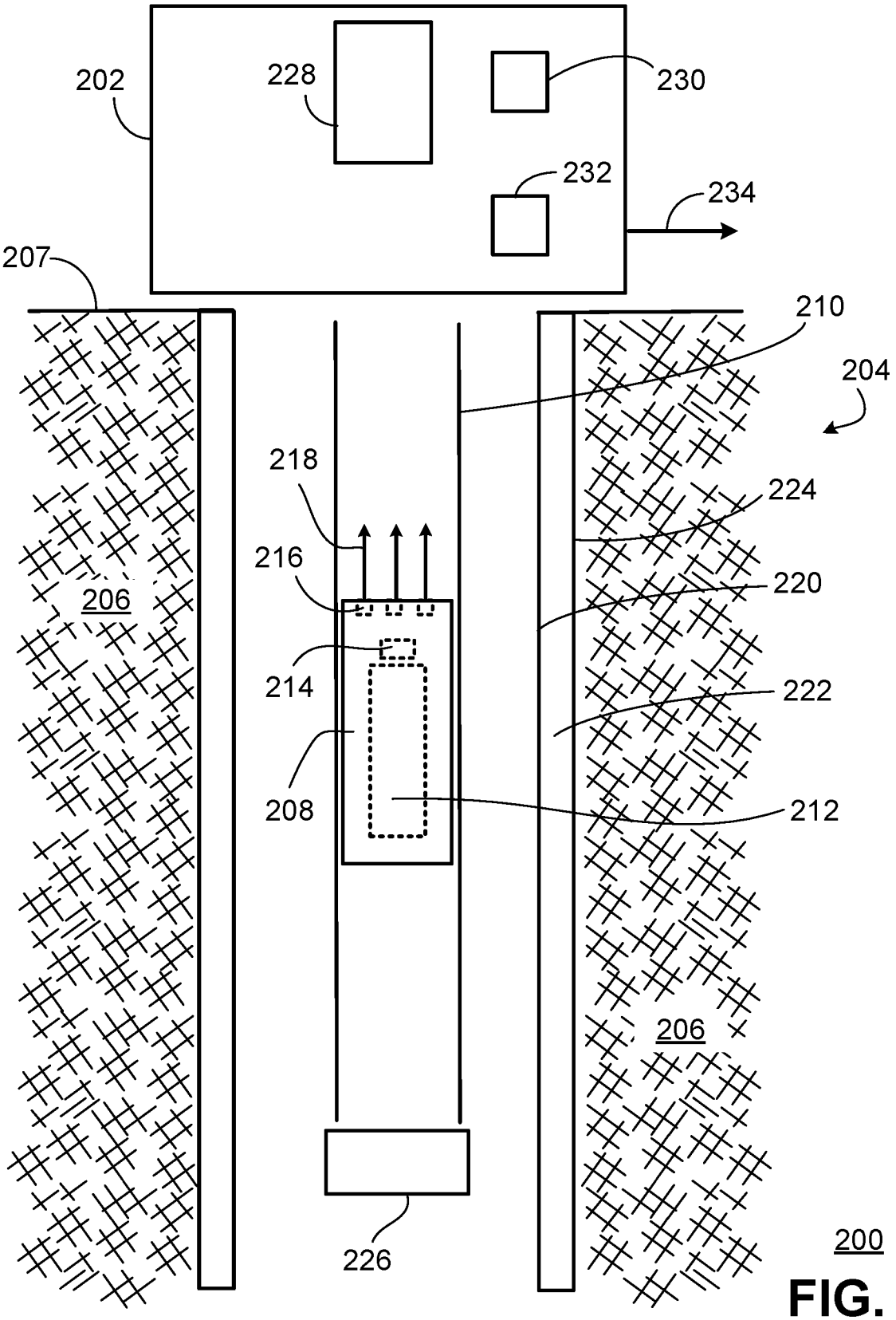
FIG. 2 is a diagram of a well having a wellhead and a wellbore in a subterranean formation.

FIG. 2 is a well 200 having a wellhead 202 and a wellbore 204 in a subterranean formation 206. The wellbore 204 is formed through the Earth surface 207 into the subterranean formation 206.

An unloading plunger 208 is depicted in production tubing 210 in the wellbore 204. The unloading plunger 208 may be analogous to the unloading plunger 100 of FIG. 1. As depicted, the unloading plunger 208 may be descending or ascending in the production tubing 210 in an unloading operation. The unloading plunger 208 includes an internal chamber 212 having compressed gas, such as compressed nitrogen. The unloading plunger 208 includes a timer-operated valve 214 to maintain the compressed gas in the internal chamber 212 and to release the compressed gas from the internal chamber 212. The compressed gas may be released per the timer-operated valve 214 from the internal chamber 212 through the nozzles 216 on an upper portion of the unloading plunger 208. The compressed gas may discharge from the nozzles 216 into liquid in the production tubing 210 above the unloading plunger 208, as indicated by arrows 218. The timer-operator valve 214 is generally closed and the compressed gas not release while the unloading plunger is descending in the production tubing 210. The timer-operator valve 214 is generally open and the compressed gas release while the unloading plunger is ascending in the production tubing 210.

In the illustrated implementation, the wellbore 204 is a cemented cased wellbore. The wellbore 204 includes a casing 220 with cement 222 in the annulus between the casing 204 and the face 224 (surface) of the subterranean formation 206. The wellbore 204 may have casing perforations through the casing 204 and cement 222 into the subterranean formation 206. The casing perforations (not shown) may provide for flow of produced hydrocarbon from the subterranean formation 206 into the wellbore 204. A bottomhole bumper 226 may be disposed in a bottom portion (bottomhole) of the wellbore 204. The bottomhole bumper 226 may have a spring. Thus, the bottomhole bumper 226 may be labeled as a bottomhole bumper spring. Moreover, while the unloading plunger 208 is depicted in the production tubing 210, other embodiments may employ an unloading plunger 208 in the wellbore 208 as interfaced with the casing 220 in sections of the wellbore 204 without production tubing 210.

The wellhead 202 may include a rest position 228 for the unloading plunger 208. In embodiments, the rest position 228 is on an upper portion of the wellhead 202. The rest position 224 may be a receptacle to receive the unloading plunger 208. In implementations, the rest position 224 is a lubricator. The lubricator is a conduit (pipe or tubing) and thus may be labeled as a lubricator pipe or lubricator tubing. In some examples, the lubricator may generally have the same inner diameter as the production tubing 210. The lubricator as a lubricator conduit may provide a hollow receptacle to receive the unloading plunger 208. The lubricator may include a spring (e.g., shock spring, bumper spring, etc.) to lessen the impact of the unloading plunger 208 when received at the lubricator (rest position 228). The rest position 228 (e.g., lubricator) may include an arrival sensor to detect receipt of the unloading plunger 208. A signal indicative of the receipt may be transmitted from the sensor to a controller 230 or other controller. The controller 230 may have a hardware processor and memory (e.g., volatile and/or nonvolatile) storing code (e.g., instructions, logic, etc.) executed by the processor. The lubricator as a rest position 224 may include a plunger catch or plunger catcher, as appreciated by the skilled artisan. The plunger catch (along with well pressure) may retain the unloading plunger 208 in the lubricator and be adjusted to release (drop) the unloading plunger 208 from the lubricator back into the production tubing 210. The lubricator with catcher may be an assembly and thus labeled as a lubricator/catcher assembly. The unloading plunger 208 at the rest position 224 may be accessible for charging gas to the inlet chamber 212, adjusting the timer on the timer-operated valve 214, and so on.

The wellhead 202 may include a production valve 232 (e.g., sales valve) for the flow (discharge) of produced hydrocarbon, such as crude oil or natural gas, or both. The hydrocarbon may flow from the production tubing 210 through the wellhead 202 and production valve 232 into a discharge conduit 234 (e.g., sales line). In embodiments, the production valve 232 may be a motor operated valve (MOV). The controller 230 or other controller may be a valve controller for the production valve 232.

In operation, the well 200 when in a loaded condition may be shut in by closing the production valve 232 (and manual valves) at the wellhead 202 to shut in the wellbore 204. The unloading plunger 208 may release from the rest position 228 and descend through the production tubing 210 to the bottom hole bumper 226 below the liquid level in the production tubing 210. Because the well 200 (wellbore 204) is shut in, the wellbore 204 pressure will increase and may reach an adequate lift pressure for the unloading plunger 208 to ascend. In some implementations, the unloading plunger 208 at bottomhole (and prior to ascent) may discharge 218 the compressed gas into the above liquid to reduce the hydrostatic pressure to facilitate start of the lift at lower bottomhole pressures. The timer-operated valve 214 may open to release gas from the internal chamber 212 and discharge 218 the gas through the nozzles 216 into the above liquid prior to the plunger 208 ascending and while the plunger 208 is ascending.

The production valve 232 at the wellhead 202 may be opened for the unloading and for the unloading plunger 208 to begin ascending in the production tubing 210 via the underlying lift. The lift may be the built-up pressure in the wellbore 204 from formation 206 pressure (e.g., near wellbore). As mentioned, the timer-operated valve 214 may be open before and during the ascent of the unloading plunger 208 to release the compressed gas from the internal chamber 212. The compressed gas discharges 218 through the nozzles 216 into the liquid in the production tubing 210 above the ascending unloading plunger 208 to reduce the hydrostatic head of the liquid. As discussed, such may make unloading feasible for lower lift pressures (lower bottomhole pressures).

As the unloading plunger 208 approaches the wellhead 202, the liquid (e.g., condensate, water, oil, etc.) above the ascending plunger 208 flows through the production valve 232 into the discharge conduit 234 and is thus unloaded from the well 200. The plunger 208 reaches the rest position 228 and the timer-operated valve 214 may close. With the well 200 unloaded, hydrocarbon (e.g., natural gas or crude oil, or both) may be produced from the subterranean formation 206. The produced hydrocarbon may flow through the production valve 232 and into the discharge conduit 234 (e.g., sales line). When the well 200 becomes loaded again with liquid, the well 200 including wellbore 204 may be shut in and the plunger 208 descended to the bottom hole to start the cycle again. There may be at least two flow periods in the plunger lift cycle: (1) unloading flow through the production valve 232 while the plunger 208 is ascending; and (2) flow (after flow) of production by the unloaded well 200 after the plunger 208 reaches the wellhead 202. During the after-flow period, the internal chamber 212 of the plunger 208 at the rest position 228 may be recharged with compressed gas. Also, the timing of the timer-operated valve 214 may be adjusted if desired during the after-flow period. The timing may be adjusted in response to changing well 200 conditions or based on a better understanding of the well 200 conditions, and the like.

The timer may include a first setting that is the length of time (interval) the timer-operated valve 214 is closed and a second setting that is the length of time (interval) the timer-operated valve 212 is open. The length of time for the timer-operated valve 214 to be closed in a cycle may include the combined time of (a) time for the plunger 208 to descend, (b) a first portion of the time the plunger 208 is at bottomhole, and (c) the after-flow time of production. The length of time for the timer-operated valve 214 to be open may include the combined time of (a) a second portion of time the plunger 208 is at bottom hole and (b) the time for the plunger 208 to ascend through the production tubing 210.

Benefits of the present unloading plunger may include increased operating range of plunger lift systems and also advanced plunger lift in low GLR wells. An advantage may be avoiding swabbing or coiled tubing intervention to unload a well in some embodiments. Further, the present unloading plunger may promote lifting more liquids in plunger lift, increase utilization of the reservoir natural energy, and increase time of producing wells while avoiding an external power source for the plunger in certain implementations.

Referring to FIG. 1 and FIG. 2, an embodiment is an unloading plunger (e.g., 100, 208) to unload liquid from a well (e.g., 200). The unloading plunger includes a body (e.g., 206) to interface with an inside surface of production tubing (e.g., 210) in a wellbore (e.g., 204) to provide a seal in the production tubing between above the unloading plunger and below the unloading plunger. The seal may seal the fluid in the production tubing above the unloading plunger from the fluid in the production tubing below the unloading plunger. The unloading plunger (e.g., steel, stainless steel, etc.) includes an internal chamber (e.g., 102, 212) to hold a compressed gas (e.g., nitrogen). The internal chamber has a chamber inlet (e.g., 112) to receive the compressed gas into the internal chamber and an outlet (e.g., 118) to discharge the compressed gas from the internal chamber. The body may have a body inlet (e.g., 110) (e.g., gas charging port) to receive (from external) and provide the compressed gas to the chamber inlet. In implementations, the internal chamber holds the compressed gas at a pressure of at least 1000 psig at charge and prior to discharge of the compressed gas.

The unloading plunger includes a timer-operated valve (e.g., 104, 214) disposed at the chamber outlet to prevent flow of the compressed gas through the outlet when the operating position of the timer-operated valve is closed. The timer-operated valve provides flow of the compressed gas from the internal chamber through the chamber outlet when the operating position is open. To provide access to the timer-operated valve, the body may have a removable head (e.g., 120) coupled (e.g., via mating threads) to the remaining portion of the body. The removable head is removable to provide access to the timer-operated valve for at least the reason to set timing of the timer-operated valve. The timer-operated valve may have at least a first time setting and a second time setting. The first time setting is length of time the timer-operated valve is in a closed operating position in a cycle. The second time setting is length of time the timer-operated valve is in an open operating position in the cycle. The timer-operated valve may have the timer to direct operating position of the valve of the timer-operated valve. In some implementations, the valve includes a plate to prevent release of the compressed gas through the outlet when the operating position is closed. In certain implementations, the timer may be a mechanical timer having an actuator to operate the valve, and wherein the timer-operated valve does not receive electricity in operation.

The unloading plunger includes a nozzle (e.g., 122, 216) in the body to receive the compressed gas from the internal chamber through the timer-operated valve and discharge the compressed gas from the unloading plunger. The nozzle may be disposed at an upper portion (top portion) of the unloading plunger to discharge the compressed gas from the upper portion into liquid above the unloading plunger in the production tubing. The nozzle may include a passage portion (e.g., 123) in the body and a nozzle outlet (e.g., 124) at an exterior surface of the body. The nozzle may be multiple nozzles (e.g., three nozzles 122, 216).

Figure 3:
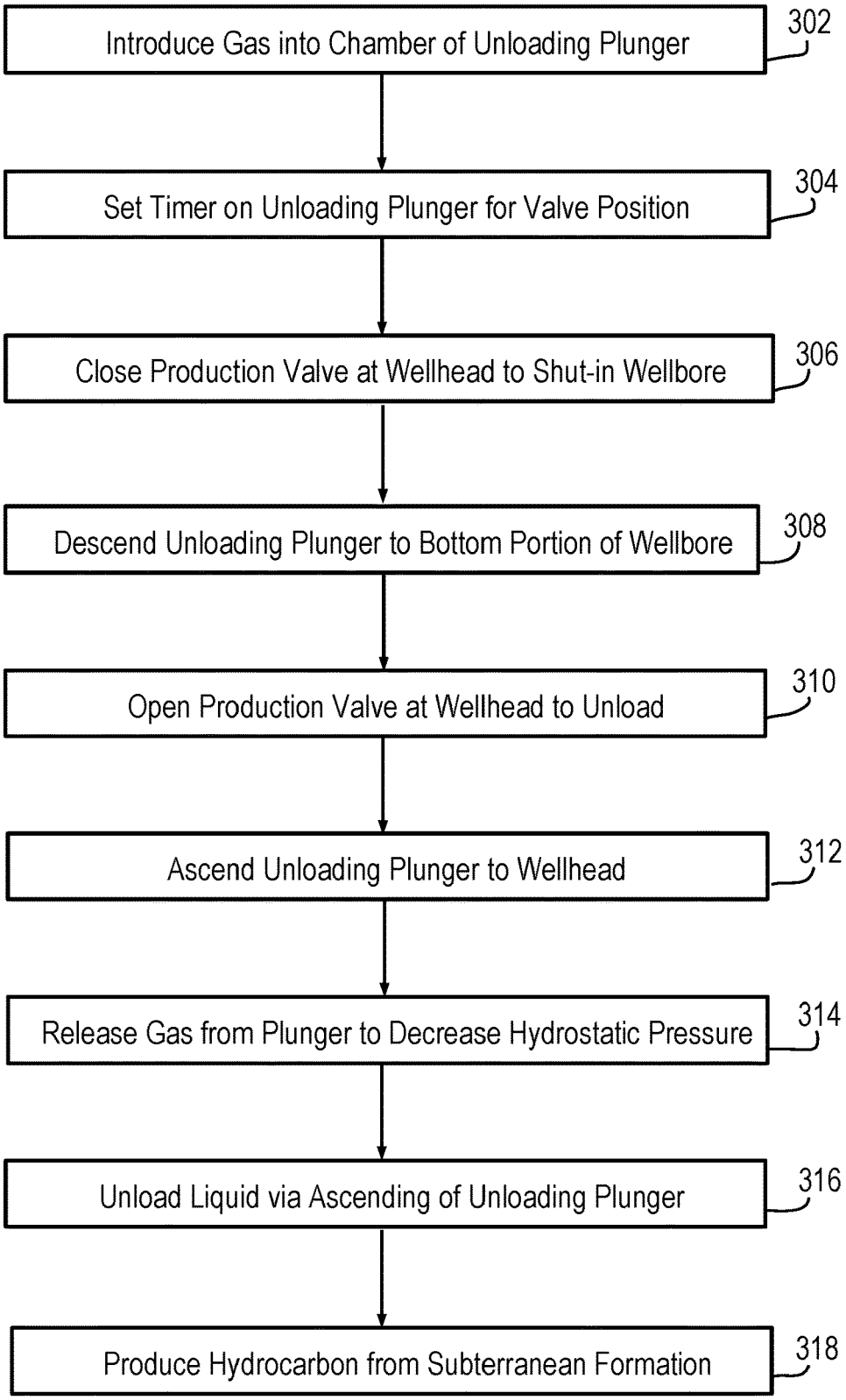
FIG. 3 is a block flow diagram of a method of operating a well having a wellhead and associated wellbore in a subterranean formation.

FIG. 3 is a method 300 of operating a well having a wellhead and associated wellbore in a subterranean formation. The method involves an unloading plunger having a chamber to receive and hold compressed gas. The chamber may be an internal chamber (e.g., interior cavity) of the unloading plunger. The compressed gas may include nitrogen (compressed nitrogen gas).

At block 302, the method includes introducing gas (e.g., nitrogen) into the chamber. The unloading plunger may be available to receive the gas (e.g., compressed gas) at the rest position at the wellhead mentioned below. The method may include injecting the compressed gas via an injection port of the unloading plunger. The introduction of the gas into the chamber may give a pressure of at least at least 1000 psig in the chamber. The compressed gas may remain at the pressure of at least 1000 psig in the chamber until the releasing of the compressed gas from the chamber.

At block 304, the method includes setting a timer on the unloading plunger for the operating position (e.g., closed and open) of a valve disposed at a discharge opening of the internal chamber. The timer may direct operating position of the valve. The valve may be a timer-operated valve (having the timer and the valve) disposed at the chamber discharge opening in the unloading plunger. The method may include inputting a first time setting to the timer that is length of time the timer maintains the valve closed (closed operating position) in a cycle, and inputting a second time setting to the timer that is length of time the timer maintains the valve open (open operating position) in the cycle. The action of setting of the timer may include accessing the timer via a removable head of the unloading plunger. The inputting of the first time setting and the second time setting may involve removing the head of the unloading plunger to access the timer. The unloading plunger may be available from the rest position at the wellhead.

In embodiments, the valve in a closed operating position prevents release of the compressed gas through the chamber discharge opening and the timer-operated valve. The valve in an open operating position may release the compressed gas through the chamber discharge opening and the timer-operated valve. In certain implementations, the timer may be a mechanical timer having an actuator to operate the valve. The mechanical timer in operation generally does not receive electricity. In particular implementations, the valve includes or is a plate that prevents release of the compressed gas through the chamber discharge opening when the valve is in a closed operating position.

At block 306, the method includes closing the production valve (e.g., 232 in FIG. 2) at the wellhead to shut-in the wellbore. The production valve may be closed and the wellbore shut-in when the well has become loaded with liquid, and hydrocarbon production is little or none. The shut-in of the wellbore may gradually increase pressure in the wellbore due to formation pressure, such as near-wellbore formation pressure.

At block 308, the method includes descending, via gravity, an unloading plunger from a rest position at the wellhead to below liquid in the wellbore or, in particular, to below liquid in production tubing in the wellbore. The descending of the unloading plunger may be to a bottom portion (e.g., bottomhole) of the wellbore. The operating position of the valve at the chamber discharge opening of the unloading plunger may be closed during the descending. The timer-operated valve may be maintained closed during the descending of the unloading plunger. In particular, the timer may maintain the valve closed (closed operating position) during the descending of the unloading plunger.

The descending of the unloading plunger to the bottom portion of the wellbore may involve descending the unloading plunger through production tubing in the wellbore. The unloading plunger may descend to a bottomhole bumper spring in certain implementations. The wellbore is shut-in during the descending of the unloading plunger. The placing of the wellbore as shut-in may involve closing (block 306) a production valve at the wellhead as mentioned, and may stop flow of fluid (if any) from the wellbore and production tubing through the production valve. As also mentioned, the shut-in of the wellbore increases pressure in the wellbore.

At block 310, the method includes opening the production valve at the wellhead to unload the wellbore and/or unload production tubing in the wellbore. The opening of the production valve and ascending (block 312) the unloading plunger through the production tubing generally displaces the liquid above the unloading plunger through the production valve to unload the liquid from the wellbore and production tubing if present.

At block 312, the method includes ascending, via bottomhole pressure provided by formation pressure, the unloading plunger from the bottom portion of the wellbore to the rest position (e.g., wellhead lubricator pipe) at the wellhead. The wellbore is generally not shut-in during the ascending of the unloading plunger. The ascending of the unloading plunger may involve ascending the unloading plunger through production tubing in the wellbore. The unloading plunger may provide a seal in the production tubing between fluid above the unloading plunger and fluid below the unloading plunger. The method may include maintaining the timer-operated valve open during the ascending of the unloading plunger. In particular, the method may include maintaining the valve open (open operating position) via the timer during the ascending of the unloading plunger.

Thus, at bock 314 with the valve open, the ascending (block 312) may involve discharging the gas from the chamber through the valve into the liquid in the wellbore or production tubing above the unloading plunger to decrease hydrostatic pressure of the liquid. At block 314, the method includes, during the ascending (block 312), releasing the compressed gas from the chamber into the wellbore to decrease hydrostatic pressure of liquid in the wellbore (e.g., in the production tubing) above the unloading plunger. The releasing of the compressed gas from the chamber may include releasing the compressed gas though the chamber discharge opening and the timer-operated valve disposed at the chamber discharge opening. As indicated, the method may include decreasing hydrostatic pressure of liquid above the plunger during the ascending by discharging, via the timer-operated valve, the compressed gas from the internal chamber through the timer-operated valve into the liquid. The releasing of the compressed gas may involve discharging the compressed gas from an upper portion of the unloading plunger (e.g., through a nozzle of the unloading plunger) into the liquid above the unloading plunger. The releasing of the compressed gas may include discharging the compressed gas from the chamber through the chamber discharge opening, the timer-operated valve, and the nozzle into the liquid.

At block 316, the method includes unloading the liquid from the wellbore via the ascending of the unloading plunger. The unloading of the liquid from the wellbore via the ascending of the unloading plunger may involve discharging the liquid through the production valve at the wellhead. Thus, the method may encompass unloading the liquid from the well via the ascending of the unloading plunger and flowing the liquid from the production tubing through the production valve, e.g., into a sales line.

At block 318, the method includes producing hydrocarbon from the subterranean formation through the wellbore and the production valve at the wellhead after unloading the liquid from the wellbore. The method may include producing the hydrocarbon from the subterranean formation through the production tubing and the production valve via formation pressure after the ascending unloading plunger reaches the wellhead. The wellbore may include casing having perforations for introduction of the hydrocarbon into the wellbore from the subterranean formation. The producing of the hydrocarbon through the wellbore may involve flowing the hydrocarbon (e.g., natural gas and/or crude oil) through production tubing in the wellbore.

As indicated, plunger lift is typically used in high GLR gas and oil wells, but is versatile to be utilized in lower GLR wells as well. The GLR is the ratio of produced gas volume to total produced liquids (oil and water) volume. As with other artificial lift methods, the purpose of plunger lift may be to remove liquids from the wellbore so that the well can be produced at lower (e.g., the lowest) bottom-hole pressure and increased (e.g., maximum) rate. A plunger lift system may rely directly on the natural buildup of pressure in a shut-in gas well and gas velocity. In examples, the plunger cycle may start on top of the bottom-hole bumper spring or in the surface lubricator. When the well is shut-in the plunger falls through the gas and liquid to the bottom-hole bumper spring. When the well is opened up, the plunger travels from the bottom-hole bumper spring to the surface. The controller opens a motor valve (production valve) at the surface and the well's shut-in pressure creates a differential pressure that forces the plunger interface up and lifts the liquid to surface. An arrival sensor (if present) recognizes the plunger arrival. The plunger provides a seal between the liquid above and the gas below, such that the well energy is used to lift liquids out of the wellbore.

Plunger lift utilizes the plunger as a piston that travels up and down in the well tubing string. It prevents or reduces liquid fallback and relies on well energy generally more efficiently than do slug or bubble flow. As with other artificial-lift methods, the purpose of plunger lift is to remove liquids from the wellbore so that the well can be produced at the lower bottomhole pressures, as mentioned. Whether in a gas well or oil well, the plunger lift may generally be the same or similar. As discussed, the plunger (e.g., a length of steel) is dropped through the tubing to the bottom of the well and allowed to travel back to the surface. The plunger provides a piston-like interface between liquids and gas in the wellbore and prevents or reduces liquid fallback. Liquid fallback may be characterized as a part of the liquid load that effectively is lost because the liquid fallback is left behind. Again, because the plunger provides a seal between the liquid above and the gas below, the well energy can be used to lift liquids out of the wellbore.

The plunger operation may generally consist of shut-in and flow periods. The flow periods may be divided into at least periods of (1) unloading and (2) flow after plunger arrival. The lengths of these periods vary with application, producing capability of the well, and pressures. A plunger cycle may start with the shut-in period that allows the plunger to drop from the surface to the bottom of the well. At the same time, the well builds fluid (gas) pressure. The well should be shut in for an adequate time to build sufficient reservoir pressure to provide energy to lift both the plunger and liquid slug to the surface against line pressure (sales line) and friction of the sales line. When this summative pressure has been reached by the bottomhole lift pressure, the flow period may be started and unloading begins. In the initial stages of the flow period, the plunger and liquid slug begin traveling to the surface. Gas above the plunger flows from the tubing into the production sales conduit, and the plunger and liquid slug follow. The plunger arrives at the surface, unloading the liquid. The well now can produce generally free of liquids, while the plunger is held at the surface (e.g., by well pressure and flow). As hydrocarbon-production rates drop, so do velocities. Eventually, velocities drop below the critical rate, and liquids begin to accumulate in the tubing. The well is shut in, and the plunger falls back to bottom to repeat the cycle.

A number of implementations have been described. Nevertheless, it will be understood that various modifications may be made without departing from the spirit and scope of the disclosure.

What is claimed is:

1. A method of operating a well comprising a wellhead and associated wellbore in a subterranean formation, the method comprising:

descending, via gravity, an unloading plunger from a rest position at the wellhead to a bottom portion of the wellbore, the unloading plunger comprising a chamber having compressed gas;

ascending, via formation pressure, the unloading plunger from the bottom portion of the wellbore to the rest position at the wellhead;

releasing the compressed gas from the chamber at an upper portion of the unloading plunger through a chamber discharge opening and a valve disposed at the chamber discharge opening into liquid in the wellbore above the unloading plunger during the ascending to decrease hydrostatic pressure of the liquid in the wellbore above the unloading plunger, wherein the unloading plunger comprises the valve that is a timer-operated valve comprising a timer;

maintaining the valve closed via the timer during the descending of the unloading plunger, and maintaining the valve open via the timer during the ascending of the unloading plunger, wherein the timer comprises a mechanical timer comprising an actuator to operate the valve, and wherein the mechanical timer does not receive electricity in operation; and unloading the liquid from the wellbore via the ascending of the unloading plunger.

2. The method of claim 1, wherein the wellbore is shut-in during the descending of the unloading plunger, and wherein the wellbore is not shut-in during the ascending of the unloading plunger.

3. The method of claim 2, wherein placing the wellbore as shut-in comprises closing a production valve at the wellhead to stop flow of fluid from the wellbore through the production valve, and wherein the shut-in of the wellbore increases pressure in the wellbore.

4. The method of claim 1, wherein the unloading of the liquid from the wellbore via the ascending of the unloading plunger comprises discharging the liquid through a production valve at the wellhead, and wherein the rest position comprises a wellhead lubricator pipe.

5. The method of claim 1, comprising producing hydrocarbon from the subterranean formation through the wellbore and a production valve at the wellhead after unloading the liquid from the wellbore.

6. The method of claim 5, wherein the wellbore comprises casing having perforations for introduction of the hydrocarbon into the wellbore from the subterranean formation, and wherein producing the hydrocarbon through the wellbore comprises flowing the hydrocarbon through production tubing in the wellbore.

7. The method of claim 1, wherein descending the unloading plunger to the bottom portion of the wellbore comprises descending the unloading plunger through production tubing in the wellbore to a bottomhole bumper spring.

8. The method of claim 1, wherein ascending the unloading plunger comprises ascending the unloading plunger through production tubing in the wellbore, and wherein the unloading plunger provides a seal in the production tubing between fluid above the unloading plunger and fluid below the unloading plunger.

9. The method of claim 1, wherein releasing the compressed gas comprises discharging the compressed gas from the valve through a nozzle at the upper portion of the unloading plunger into the liquid above the unloading plunger, and wherein the chamber comprises an internal cavity of the unloading plunger.

10. The method of claim 9, wherein the nozzle comprises multiple nozzles of the unloading plunger downstream of the valve, wherein a passage in the body of the unloading plunger couples the valve with the multiple nozzles, and wherein the compressed gas comprises a pressure in a range of 1000 pounds per square inch gauge (psig) to 5000 psig in the chamber before the releasing of the compressed gas from the chamber.

11. The method of claim 10, wherein each nozzle of the multiple nozzles comprises a passage portion coupled to the passage in the body of the unloading plunger and an ejection opening at an exterior top surface of the body.

12. The method of claim 9, wherein a passage in a body of the unloading plunger couples the valve to the nozzle, and wherein the nozzle comprises an ejection opening at a top exterior surface of the body of the unloading plunger.

13. The method of claim 1, comprising inputting a first time setting to the timer that is length of time the timer maintains the valve closed in a cycle, and inputting a second time setting to the timer that is length of time the timer maintains the valve open in the cycle.

14. The method of claim 13, wherein inputting the first time setting and the second time setting comprises removing a head of a body of the unloading plunger to access the timer, wherein the unloading plunger is available from the rest position at the wellhead.

15. The method of claim 1, and wherein the compressed gas comprises nitrogen.

16. The method of claim 1, wherein the timer directs operating position of the valve, wherein the valve comprises a plate that prevents release of the compressed gas through the chamber discharge opening when the valve is in a closed operating position.

17. The method of claim 1, wherein the unloading plunger comprises a nozzle at an upper portion of the unloading plunger to receive the compressed gas from the timer-operated valve, and wherein releasing the compressed gas comprises discharging the compressed gas from the chamber through the chamber discharge opening, the timer-operated valve, and the nozzle into the liquid.

18. The method of claim 1, comprising introducing the compressed gas into the chamber via an injection port of the unloading plunger disposed at a bottom portion of the unloading plunger, wherein the valve in a closed operating position prevents release of the compressed gas through the chamber discharge opening and the timer-operated valve, and wherein the valve in an open operating position releases the compressed gas through the chamber discharge opening and the timer-operated valve.

19. The method of claim 1, comprising introducing the compressed gas into the chamber via an injection port of the unloading plunger as available at the rest position at the wellhead, and wherein the chamber comprises an internal chamber of the unloading plunger.

20. A method of operating a well comprising a wellhead operationally coupled to a wellbore in a subterranean formation, the method comprising:

introducing compressed gas into an internal chamber of an unloading plunger via an injection port of the unloading plunger disposed at a bottom portion of the unloading plunger;

closing a production valve at the wellhead to shut-in the wellbore and descending, via gravity, the unloading plunger from the wellhead through production tubing to a bottomhole of the wellbore, the unloading plunger comprising the internal chamber having the compressed gas;

opening the production valve and ascending, via formation pressure, the unloading plunger from the bottomhole through the production tubing to the wellhead;

decreasing hydrostatic pressure of liquid above the unloading plunger in the production tubing during the ascending by discharging, via a timer-operated valve of the unloading plunger, the compressed gas from the internal chamber through the timer-operated valve at an upper portion of the unloading plunger into the liquid above the unloading plunger;

maintaining a valve of the timer-operated valve in a closed operating position via a timer of the timer-operated valve during the descending of the unloading plunger, and maintaining the valve in an open operating position via the timer during the ascending of the unloading plunger in the production tubing, wherein the timer comprises a mechanical timer comprising an actuator to operate the valve, and wherein the mechanical timer does not receive electricity in operation; and unloading the liquid from the well via the ascending of the unloading plunger, wherein the unloading comprises flowing the liquid from the production tubing through the production valve.

21. The method of claim 20, comprising maintaining the timer-operated valve closed during the descending of the unloading plunger, and maintaining the timer-operated valve open during the ascending of the unloading plunger.

22. The method of claim 20, comprising inputting a first time setting to a timer of the timer-operated valve that is length of time the timer maintains a valve of the timer-operated valve in a closed operating position in a cycle, and inputting a second time setting to the timer that is length of time the timer maintains the valve in an open operating position in the cycle.

23. The method of claim 20, wherein discharging the compressed gas comprises discharging the compressed gas from the timer-operated valve through multiple nozzles of the unloading plunger at the upper portion of the unloading plunger, wherein each nozzle of the multiple nozzles comprises a nozzle outlet at a top exterior surface of a body of the unloading plunger, and wherein the compressed gas comprises nitrogen.

24. A method of operating a well comprising a wellbore in a subterranean formation and a wellhead at Earth surface adjacent to the wellbore, the method comprising:

introducing gas into an internal chamber of an unloading plunger via an injection port of the unloading plunger disposed at a bottom portion of the unloading plunger;

setting a timer on the unloading plunger for operating position of a valve, the valve disposed at a discharge opening of the internal chamber at an upper portion of the unloading plunger, wherein the operating position comprises closed and open, wherein the timer comprises a mechanical timer comprising an actuator to operate the valve, and wherein the mechanical timer does not receive electricity in operation;

descending the unloading plunger from the wellhead through production tubing to below liquid in the production tubing, wherein the operating position of the valve is closed during the descending; and opening a production valve at the wellhead and ascending the unloading plunger through the production tubing to displace the liquid above the unloading plunger through the production valve to unload the liquid from the production tubing, wherein the ascending comprises discharging the gas from the chamber through the valve into the liquid in the production tubing above the unloading plunger to decrease hydrostatic pressure of the liquid.

25. The method of claim 24, comprising producing hydrocarbon from the subterranean formation through the production tubing and the production valve via formation pressure after the unloading plunger in ascending reaches the wellhead.

26. The method of claim 24, wherein discharging the gas from the chamber comprises discharging the gas through the valve and a nozzle of the unloading plunger at the upper portion of the unloading plunger into the liquid in the production tubing above the unloading plunger, and wherein the nozzle comprises an ejection opening at a top exterior surface of a body of the unloading plunger.

27. The method of claim 24, wherein introducing gas into the internal chamber gives a pressure in a range of 1000 pounds per square inch gauge (psig) to 5000 psig in the internal chamber, wherein the gas comprises nitrogen, and wherein setting the timer comprises accessing the timer via a removable head of the unloading plunger.

28. An unloading plunger to unload liquid from a well, the unloading plunger comprising:

a body to interface with an inside surface of production tubing in a wellbore to provide a seal in the production tubing between above the unloading plunger and below the unloading plunger;

an internal chamber to hold a compressed gas, the internal chamber comprising a chamber inlet disposed at a bottom portion of the unloading plunger to receive the compressed gas into the internal chamber and an outlet disposed at an upper portion of the unloading plunger to discharge the compressed gas from the internal chamber;

a timer-operated valve disposed at the outlet to prevent flow of the compressed gas through the outlet when an operating position of the timer-operated valve is closed and to provide flow of the compressed gas through the outlet from the internal chamber when the operating position is open, wherein the timer-operated valve comprises a mechanical timer comprising an actuator to operate a valve of the timer-operated valve, and wherein the timer-operated valve does not receive electricity in operation; and a nozzle in the body at the upper portion of the unloading plunger to receive the compressed gas from the outlet of the internal chamber through the timer-operated valve and discharge the compressed gas from the unloading plunger into liquid above the unloading plunger in the production tubing.

29. The unloading plunger of claim 28, wherein the nozzle comprises multiple nozzles, wherein the timer-operated valve comprises the mechanical timer to direct operating position of the valve of the timer-operated valve, and wherein the mechanical timer and the valve do not receive electricity in operation.

30. The unloading plunger of claim 28, wherein the nozzle comprises a passage portion in the body and a nozzle outlet at a top exterior surface of the body, and wherein the compressed gas comprises nitrogen.

31. The unloading plunger of claim 28, wherein the nozzle comprises multiple nozzles, wherein the internal chamber is configured to hold the compressed gas at a pressure in a range of 1000 pounds per square inch gauge (psig) to 5000 psig prior to discharge of the compressed gas from the unloading plunger.

32. The unloading plunger of claim 28, wherein the body comprises a body inlet at the bottom portion of the unloading plunger to receive and provide the compressed gas to the chamber inlet, and wherein the seal is configured to seal fluid in the production tubing above the unloading plunger from fluid in the production tubing below the unloading plunger.

33. The unloading plunger of claim 32, wherein the nozzle comprises an ejection opening at a top exterior surface of the body for discharge of the compressed gas from the unloading plunger, wherein the body inlet comprises a gas charging port at the bottom portion of the unloading plunger, and wherein the body comprises steel.

34. The unloading plunger of claim 28, wherein the timer-operated valve comprises a first time setting that is length of time the timer-operated valve is in a closed operating position in a cycle, and wherein the timer-operated valve comprises a second time setting that is length of time the timer-operated valve is in an open operating position in the cycle.

35. The unloading plunger of claim 28, wherein the body comprises a removable head coupled to a remaining portion of the body, the removable head being removable to provide access to the timer-operated valve to set timing of the timer-operated valve.

36. The unloading plunger of claim 35, wherein the removable head is coupled to the remaining portion of the body via mating threads.

37. The unloading plunger of claim 28, wherein the timer-operated valve comprises the timer to direct operating position of the valve of the timer-operated valve, wherein the valve comprises a plate to prevent release of the compressed gas through the outlet when the operating position is closed.

* * * * *